US006971596B2

(12) United States Patent
Monroe

(10) Patent No.: US 6,971,596 B2
(45) Date of Patent: Dec. 6, 2005

(54) SNOW AND/OR ICE LIQUEFIER

(76) Inventor: James C. Monroe, P.O. Box 697, Gray, ME (US) 04039

( * ) Notice: Subject to any disclaimer, the term of this patent is extended or adjusted under 35 U.S.C. 154(b) by 57 days.

(21) Appl. No.: 10/729,306

(22) Filed: Dec. 5, 2003

(65) Prior Publication Data

US 2005/0121547 A1 Jun. 9, 2005

(51) Int. Cl.[7] ..... B07B 13/00; B02C 19/06; B02C 21/00

(52) U.S. Cl. ..... 241/86.1; 241/DIG. 17; 241/23; 241/5

(58) Field of Search ..... 241/DIG. 17, 5, 241/23, 65, 86.1

(56) References Cited

U.S. PATENT DOCUMENTS

| | | | | |
|---|---|---|---|---|
| 642,314 A | | 1/1900 | Finigan | |
| 1,388,027 A | * | 8/1921 | Connolly | 126/343.5 R |
| 3,375,776 A | | 4/1968 | Dyson | |
| 4,164,820 A | * | 8/1979 | Krickovich | 37/229 |
| 4,785,561 A | | 11/1988 | Swanson | |
| 5,079,865 A | | 1/1992 | Hutson | |
| 5,199,198 A | | 4/1993 | Godbout | |
| 5,240,599 A | | 8/1993 | Kew et al. | |
| 5,282,980 A | | 2/1994 | Kew et al. | |
| 5,522,553 A | | 6/1996 | LeClair et al. | |
| 5,953,837 A | | 9/1999 | Clifford | |
| 6,402,065 B1 | | 6/2002 | Higgins | |

OTHER PUBLICATIONS

The Kady Mill; Brochure of Kady International of Scarborough, Maine, Feb. 1998.

TRECAN Snow Melting Equipment; Brochure of Trecan Combustion Limited, Hubley, Nova Scotia (undated).

* cited by examiner

*Primary Examiner*—Derris H. Banks
*Assistant Examiner*—Faye Francis
(74) *Attorney, Agent, or Firm*—Patricia M. Mathers; Thomas L. Bohan

(57) ABSTRACT

A method of and system for liquefying snow. The system includes a rotor-stator device mounted within a melting reservoir and having a slotted rotor and a slotted stator. Snow and/or ice is deposited in a water bath in the melting reservoir. The rotor rotates at high speed, hurling particles of crystalline snow from the tips of the rotor slots onto the perpendicular faces of the stator, thereby fracturing the crystals and promoting liquefication. The high mechanical forces generated during operation of the rotor-stator device also contribute a significant amount of heat that is applied directly to the snow. The system also includes ancillary assemblies, such as heat-exchangers and snow-transport means. The system is operable as a stationary unit or a mobile unit.

5 Claims, 5 Drawing Sheets

SNOW AND/OR ICE LIQUEFIER

BACKGROUND INFORMATION

1. Field of the Invention

The invention relates to the field of snow and ice removal. More particularly, the invention relates to a method of liquefying snow and ice.

2. Description of the Prior Art

Snow removal from roadways, airport tarmacs, and other ground surfaces is a major task in geographic areas where snow accumulation negatively affects public safety, transportation and commerce. On ground surfaces, in geographic areas where snow removal is required either by statute, public convenience or business operations, significant resources are already being expanded to remove and dispose of the snow. However, substantial challenges remain to dispose of the removed snow in a cost-effective, safe, and environmentally acceptable manner. Historically, it was common for areas having ready access to bodies of water, rivers or unused land for snow to be hauled and dumped into the water or onto the land. More recently, considerations regarding debris and particulate or chemical contaminants typically contained in removed snow have resulted in severe limitations on the legality of dumping removed snow directly into water bodies. Federal and state environmental agencies have instituted restrictive permitting and monitoring requirements, restricting or prohibiting the of dumping snow into water bodies or into land snow dumps. The difficulty in obtaining permits for land snow dumps has also subsequently diminished their availability and practicability.

In addition to the environmental difficulties and hazards linked with land snow dumps, the cost of real estate may make creating and maintaining land snow dumps prohibitively expensive. In many geographical areas, it is not cost effective to use tracts of land for snow dumps or to transport snow by truck or other means to distant land tracts that may be permittable and available. If it is not practical or feasible to haul removed snow then two basic alternatives remain; to pile the snow and leave it to melt naturally over time, or to melt the snow in commercially available snow melters. Presently, conventional snowmelters generally fall into three categories: combustion melters that apply a fossil-fuel flame either directly to the deposited snow or to a water bath which melts the snow; heat exchangers, whereby deposited snow comes into contact with tubes carrying fluids heated by external boilers and melts; and resistance heater snowmelters comprising resistance heaters powered by external electric generators or other electrical power source, whereby snow comes into contact with the heated plates and melts.

The family of TRECAN snow melters, available in advertised increments ranging from 20 tons per hour to 350 tons per hour of melting capacity, is representative of an example of conventional combustion-type snow melters. TRECAN melters basically consist of an open top, water-filled reservoir for receiving snow deposits and one or more engine-driven, forced air fossil fuel burners. The fuel-air mix is ignited and combustion occurs just before the mix enters the reservoir. The resultant combustion gases form hot gas bubbles as the gasses are force-driven into the snow water mix in the melting reservoir. Melting occurs as the heat in the rising gas bubbles transfers to the cold snow water mix in the reservoir. There are several disadvantages to the TRECAN or other similar direct combustion type snow melters: for one, a significant amount of the heat contained in the rising gas bubbles is lost to the desired melting process as the gas bubbles rise and exit the open top of the melting reservoir; and for another, the exiting gas bubbles create an oxygen diminished vapor plume above the reservoir, which creates an extraordinary health hazard to operating personnel and others exposed to the plume. TRECAN openly admits to the hazard from the plume and marks their melters accordingly.

All conventional snow melters have several disadvantages. Conventional melters generate the heat required to melt the snow by means external to the melting process. Conventional melters must induce sufficient heat into the process to elevate the process temperature to above the 32 F necessary to convert crystalline snow to a liquid state. Conventional melters rely solely on thermal migration of heat from heated surfaces to the cold snow and, consequently, the amount of total BTUs applied to the existing conventional melting processes far exceeds the amount of BTUs required to melt the amount of snow processed.

What is needed, therefore, is a method of and apparatus for liquefying snow that does not rely solely on the application of external heat to melt the snow. What is further needed is such a method wherein heat is created within a melt reservoir and directly applied to the melt process. What is yet further needed is such a method that is capable of converting the crystalline snow to liquid water at sub-freezing temperatures. What is still further needed is such a method wherein the amount of BTUs actually applied to the process approaches the amount of BTUs actually required to melt the amount of snow processed. What is even further needed is such a method and apparatus that present minimal operating hazards. What is even yet further needed is such apparatus that is easily adaptable for use as a mobile unit or a stationary unit.

BRIEF SUMMARY OF THE INVENTION

For the above stated reasons, it is an object of the present invention to provide a method of and apparatus for liquefying snow that does not rely solely on the application of externally generated heat to melt the snow. It is a further object of the present invention to provide a method wherein heat is created within the melt reservoir and applied directly to the snow melting process. It is even further an object to provide such a method wherein snow can be liquefied at sub-freezing temperatures. It is still further an object to provide a method wherein a high percentage of the heat generated by the process is retained in the process and not given off as waste heat. It is even yet a further object to provide a method and apparatus that creates no abnormal operating hazards. It is still yet further an object to provide an apparatus that is easily adaptable for use as a mobile or stationary unit.

The objects of the invention are achieved by providing a method of liquefying snow utilizing a rotor-stator device to apply mechanical forces to the mass of snow to be melted as a means of simultaneously generating heat and fracturing the frozen snow crystals. The basic snow melting apparatus according to the invention comprises a rotor-stator device, a drive motor to drive the rotor, a melting pit or reservoir for receiving and holding snow to be melted, and basic process controls. An expanded system includes heat-exchanger apparatus to enhance the process of liquefaction. It is noted that the term "snow" as used hereinafter includes snow or a mixture of snow and ice. The snow melting apparatus may be configured as an above-ground stationary or mobile unit. In an above-ground unit, a means of conveyance is used to transport snow from ground level to the open top of the melt reservoir. Snow melting apparatus that is configured as a stationary unit may also be placed below ground, with the top of the reservoir flush with or slightly below ground level. The snow to be melted can then be pushed into the melt reservoir with conventional snow-moving equipment.

The method of the present invention was reduced to practice with a rotor-stator device that is a dispersion mill. In particular, the mill is a KADY mill, as disclosed in U.S. Pat. Nos. 5,522,553 and 6,402,065, both of which are herein incorporated by reference. The mill is mounted in the melt reservoir which holds snow to be melted. Typically, the mill is mounted in the floor of the melting pit. The reservoir contains a water bath and snow is loaded into it above the mill. The mill has a slotted rotor that rotates within a slotted stator. The rotor, rotating at high speed, continuously expels material from its perimeter, thereby creating a vortex, which draws the snow down into the center of the slotted rotor. The high-speed rotation of the rotor forces the snow through the rotor slots, hurling the snow from the slot tips at velocities in the range of 9,000 ft/min. The snow is fractured when it hits the stator and exits the mill through the stator slots. The distance between the outer perimeter of the rotor and the inner perimeter of the stator is closely toleranced and adjusted so that the mill operates at its optimal capacity, which, with the KADY mill used, is 100 hp.

A key feature of the method according to the invention is that heat generated by the drive system as a by-product of the mechanical work to drive the mill itself is drawn into the mill and applied to the snow in the reservoir. But much more importantly, tremendous forces operate on the snow during operation of the mill, releasing heat that works directly on the snow as the snow passes through the mill. These forces are the result of the turbulence generated at the interface between rotor and stator and the compressive and friction forces resulting from the direct impingement of the particles of snow against other particles of snow and against the stator faces. As documented in publications and confirmed by experiment, 75% or more of the mechanical energy consumed in driving the mill is convertible to heat energy within the operating mill and is then applied directly to the snow as the snow water mix passes through the mill. Ideally, the mill is adjusted to obtain the desirable conversion of mechanical energy into heat energy.

Using the method according to the invention, one or more rotor-stator devices or mills are positioned within the confines of a large melting reservoir, typically in the floor. The snow is loaded into the top of the reservoir, drawn into the one or more rotating rotors and expelled as liquid from the one or more stators. To prevent the reservoir from overflowing as newly deposited snow is converted to liquid, a vertical weir slot, narrower at the bottom and wider at the top, is affixed near the top of the reservoir and connected to a discharge tube. The tapered weir serves to retain heat in the reservoir by metering discharge flow and maintaining proper reservoir fluid levels. In an expanded operating system, a pump is used to draw liquid from the reservoir and force the liquid through heat-exchanging apparatus to recover heat generated by extraneous operating systems, such as heat from the mill drive systems, from an engine coolant system, and from exhaust from an engine used to power the mill drive systems. The heated water exiting the heat exchanger apparatus is then sprayed onto the snow as it enters the top of the reservoir, as a means of aiding in melting the snow and enhancing the melting capacity of the operating snow melting system.

The mechanical action of the rotor-stator device generates tremendous turbulence because of the high-speed rotation and the change in geometry at the rotor slot end. As a result, tremendous forces of friction and compression act on the particles of snow as the particles impinge against the stator faces and against other particles. These forces act directly on the particles of snow, fracturing the snow crystals and contributing a significant amount of heat that also operates on the snow. Thus, it is possible to convert snow to a liquid state at temperatures below the freezing point. The continuing pumping action of the mill contributes sufficient flow velocities within the reservoir to keep the liquefied snow in a liquid state at sub-freezing temperatures. The inventor of the present invention has carried out successful snow-liquefying experiments wherein the contents of the melting reservoir are maintained in a liquid state at 6 deg F. below the freezing point of water.

Process controls monitor the temperature of the subfreezing reservoir contents. Ideally, the liquefied snow-and-water mix is retained in the reservoir sufficiently long to allow the temperature to rise to an above-freezing temperature that will allow the liquid to be discharged from the reservoir. The mill generates so much heat that continuing processing elevates the temperature of the mix to an acceptable discharge temperature. If it is possible to discharge the liquefied snow-and-water mix into a below-ground drainage system with an ambient temperature above freezing, then the mix may be discharged while still at a sub-freezing temperature.

The volume of snow that must be removed from surfaces, such as roadways and airport runways or tarmacs, and then liquefied is typically very large. The configuration of the apparatus according to the invention ideally includes equipment of sufficient capacity to liquefy such large volumes of snow most efficiently within an acceptable period of time. The KADY mill used by the inventor is an example of such equipment. This mill is a 100 hp mill driven by a 150 hp diesel engine. A single 100 hp mill is capable of liquefying 20 tons of snow per hour while maintaining the industry common discharge temperature of 37 F. It is practical to install up to four (4) 100 hp mills powered by a 500 hp diesel engine in a single melt reservoir thereby increasing the melting capacity to 80 tons per hour. Mills of 400 hp or more are readily available, thereby further increasing the potential melting capacity of the present invention. In the converse, mills of less than 100 hp can be used in applications requiring less melting capacity. It is noted that the operating melting capacity increases proportionally to a drop in the acceptable discharge temperature.

It is also possible to add low eutectic melting aids to the snow-water mix in the reservoir, whereby the term "low eutectice melting aids" includes additives such as common road salt and calcium chloride, or any additive that lowers the freezing point of water. Lowering the re-freeze temperature of the discharge effectively increases the operating melting capacity. For example, it is known that a mixture of 2.5% (wt.) of common road salt and water lowers the freezing point of the resultant mix to 30 F. The mechanical action of the mill enhances the ordinary effectiveness of the melting aid by first breaking the melting aid down into its smallest particle size, thereby increasing the effective surface area of the melting aid as it passes through the mill. Also, the direct impingement action occurring within the mill forces immediate contact between the particles of the melting aid and the particles of snow. As a result, even the addition of relatively small amounts of common melting aids to the process according to the present invention increases the operational capacity of the method significantly and allows the process to be effective at even lower temperatures.

The apparatus according to the invention is configurable as a versatile, modular system adaptable to stationary or mobile operations. For example, one configuration of the system is suitable for installation as a stationary snow-liquefication unit set up as a permanent installation at a particular site. In another configuration, the system is configurable as a mobile unit in which the reservoir, rotor-stator device, and drive motor are assembled into a transportable unit that is moved to the site of snow removal by a separate prime mover. In another configuration, the system is configurable as a self propelled unit in which the reservoir, rotor stator device, drive motor and prime mover chassis are assembled as a unit, typically with a means of conveyance included as part of the assembly to transport snow from the ground to the melting reservoir.

The description of the method and apparatus according to the invention refers to a KADY mill as the rotor-stator device used to liquefy the snow. It is understood the method and apparatus include any rotor-stator device that has operational characteristics that provide the necessary velocity to fracture the snow crystals and the necessary configuration to provide the direct impingement capability.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1:
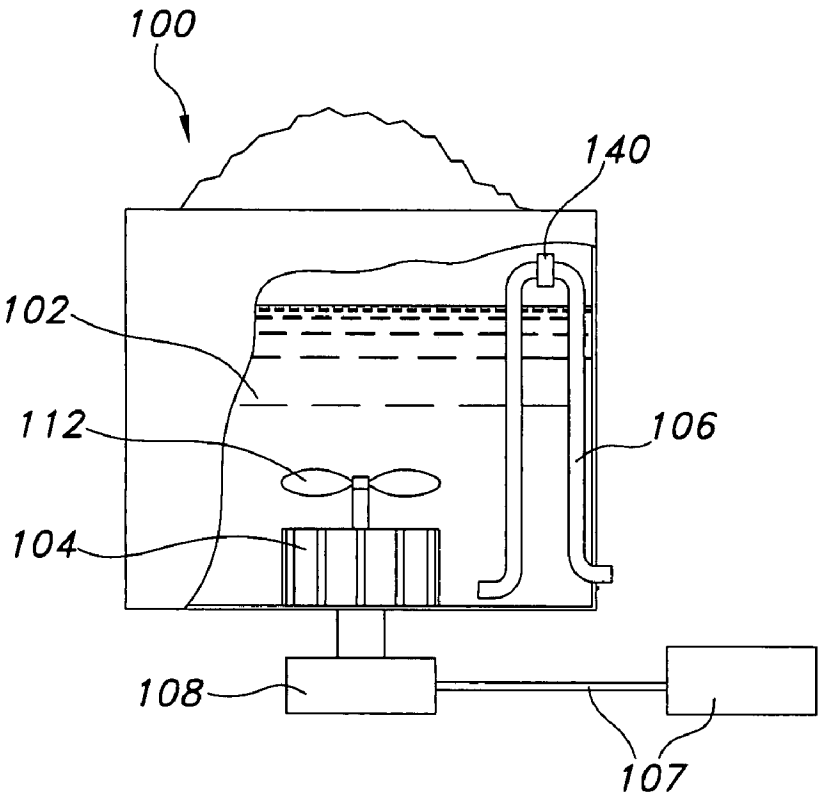
FIG. 1 is an illustration of the basic snow melting apparatus according to the invention.

FIG. 1 is an illustration of snow-liquefying apparatus 100 that is required to practice the method according to the invention. Shown are a melting reservoir 102, a rotor-stator device 104, a discharge 106, and a drive system 107 that includes a motor 108. By way of example, in snow-liquefying apparatus 100 sized to liquefy 20 tons of snow and ice per hour, a 150 hp John Deere diesel engine (or any engine or motor capable of, delivering 150 hp to the shaft) serves as the drive motor 108 to drive the rotor-stator device 104, which is a 100 hp KADY mill. The rotor-stator device 104 is mounted in the floor of the melting reservoir 102 in the embodiment shown, although it is noted here that this shall not be construed as a limiting configuration. The rotor-stator device 104 may also be mounted, for example, in a sidewall of the reservoir 102, or on a shaft that is independent of the reservoir and suspended down into the reservoir. The rapid rotational motion of the rotor 220 creates a vortex that pulls the snow and water down into the rotor 220. In the embodiment shown, a propeller mechanism 112 for forcing snow and water down into the rotor 220 is mounted at the top of the rotor-stator device 104 as an auxiliary device.

Figure 2:
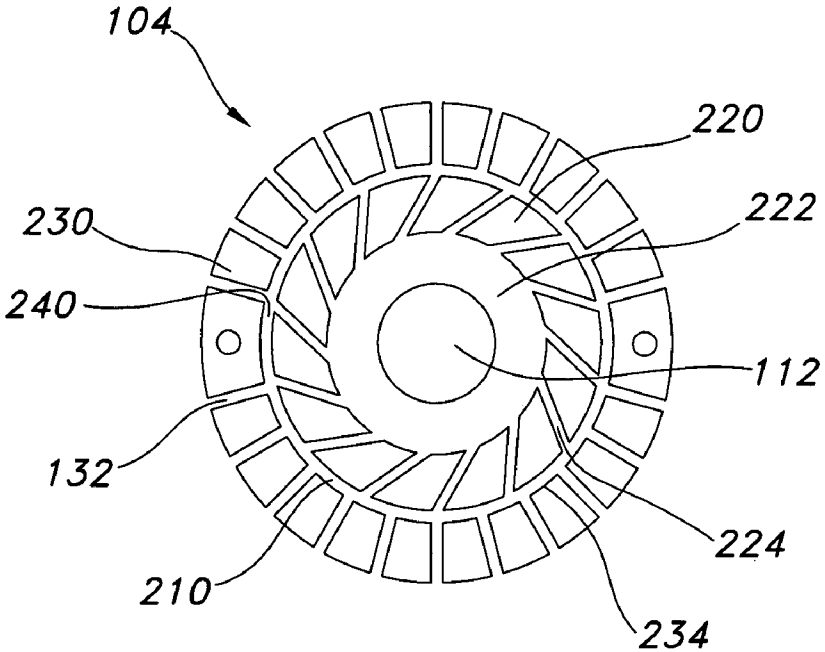
FIG. 2 (PRIOR ART)
FIG. 2 is an illustration of the rotor-stator device. (prior art)

FIG. 2 is an illustration of the rotor-stator device 104. As shown, a rotor 220 is mounted within an area bounded by the stator 230. During operation, the rotation of the rotor 220 creates a vortex that draws the snow down into an entry area 222 in the rotor 220, which rotates at high speed. This action is enhanced by the propeller mechanism 112. The snow is forced through rotor slots 224 and flung against flat faces 234 of the stator 230 and eventually expelled as liquid through stator slots 132. A clearance space 240 is provided between the rotor 220 and the stator 230, to ensure that the rotor 220 does not damage the stator 230 during rotation. This clearance space 240 is closely toleranced and adjustable to acheive the desired mechanical-to-heat-energy conversion factor.

Figure 3:
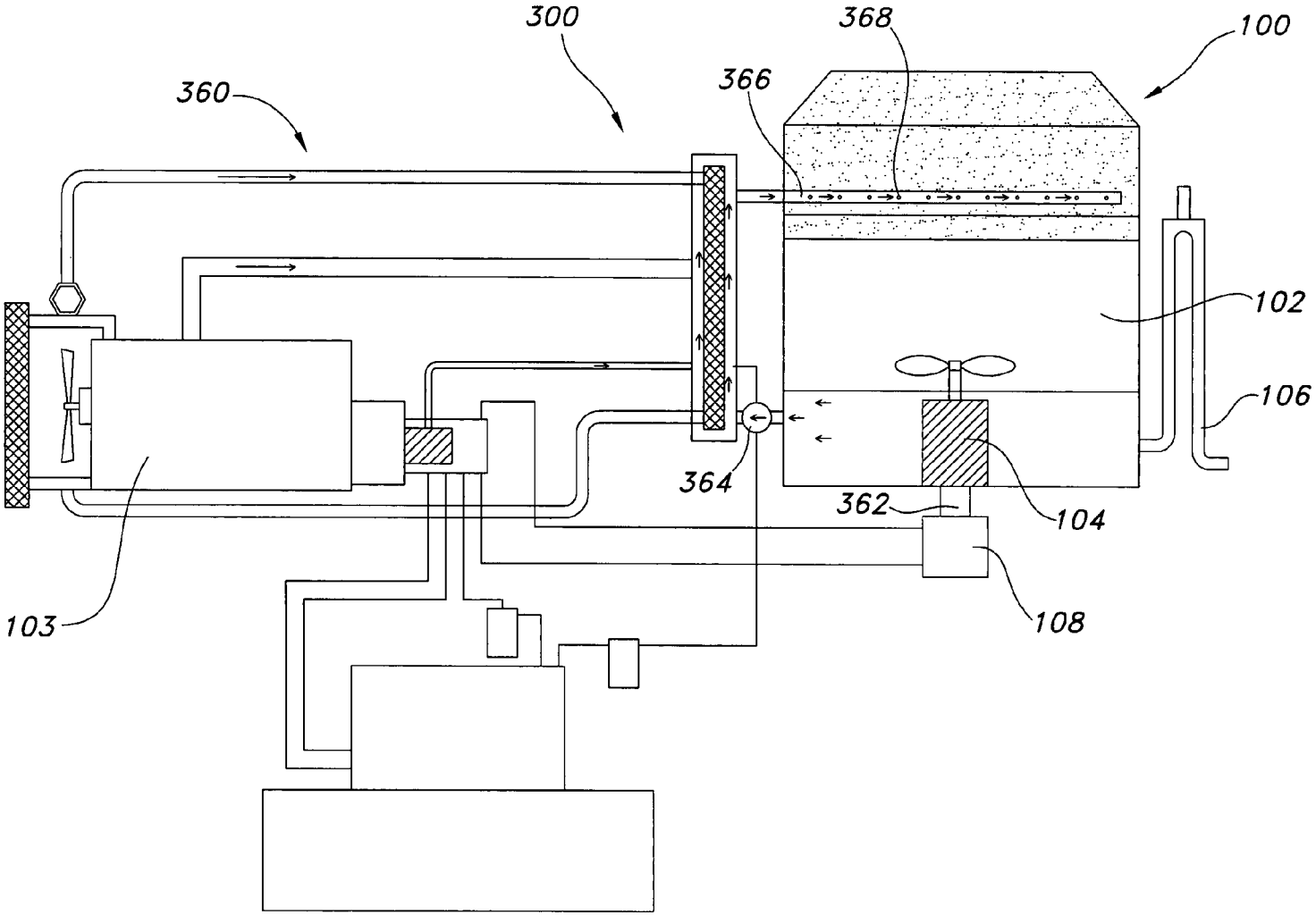
FIG. 3 is a block diagram of the system according to the invention, showing the mill and drive motor, the melting reservoir, and heat-exchange apparatus.

FIG. 3 is an illustration of a snow-liquefying system 300 that includes the snow-liquefying apparatus 100 and heat-exchange apparatus 360. As shown, a hydraulic drive 362 for driving the rotor-stator device 104 is driven by the drive motor 108, which in the embodiment shown is a diesel engine. Water is taken from the bottom of the melting reservoir 102 at a circulator-pump inlet 364, passed through the heat-exchange apparatus 360 to draw heat from heat exchangers to raise the temperature of the water, which is then fed into the melting reservoir 102. In the embodiment shown, the water is discharged through a sprayer 366 and expelled through pressure spray nozzles 368 onto the snow.

Figure 4:
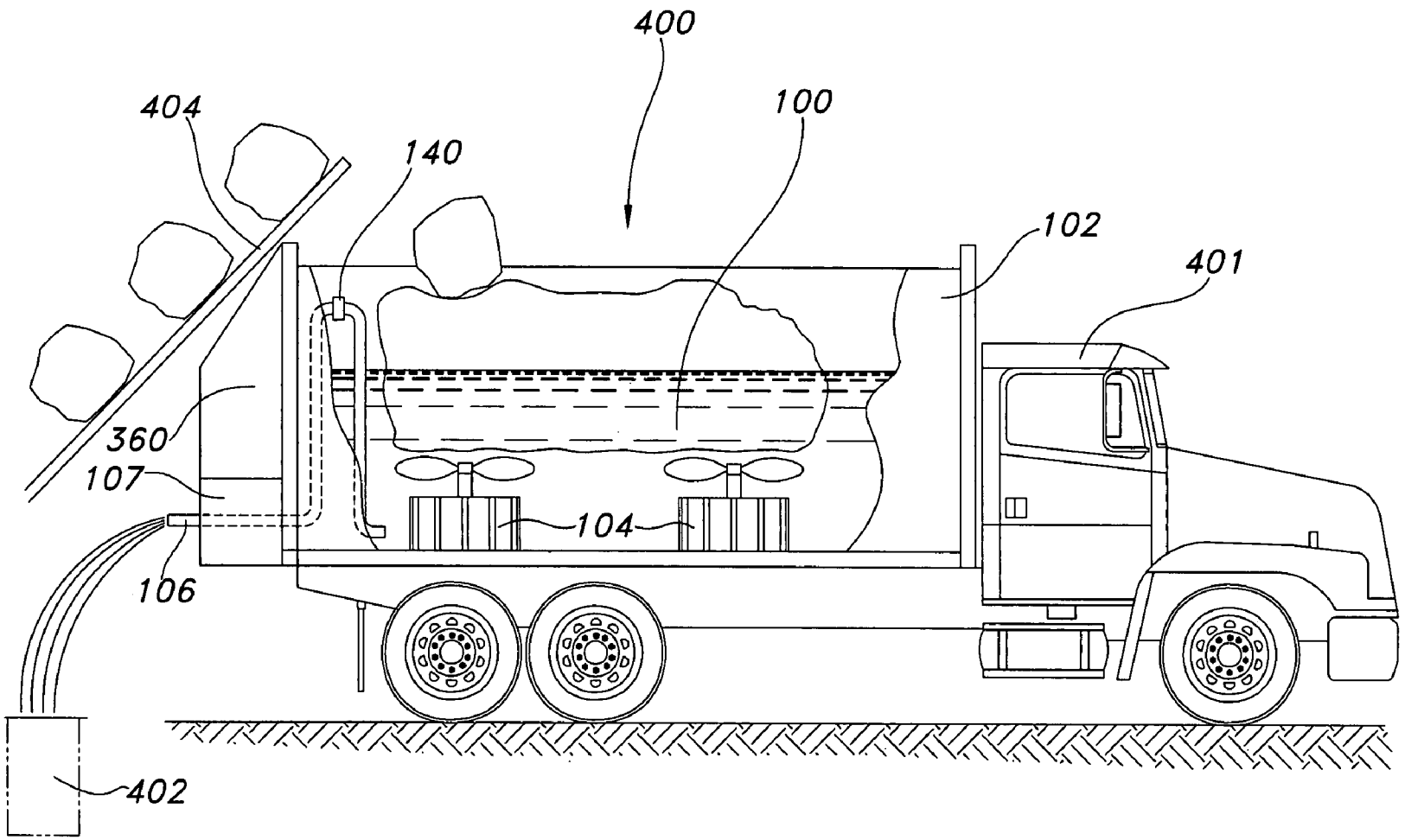
FIG. 4 is an illustration of one embodiment of a mobile snow-liquefying unit according to the invention, showing the use of a conveyor to load snow into the melting reservoir.

FIG. 4 is an illustration of a snow-liquefying system 400 configured as a mobile unit. The snow-liquefying system 400 includes the snow-melting apparatus 100. As shown, the melting reservoir 102 is constructed as a trailer rig that is towed by a conventional tractor 401. In the particular embodiment shown, two rotor-stator devices 104 are mounted in the bottom of the melting reservoir 102, thereby providing the snow-liquefying system 400 according to the invention with a snow-liquefying capacity of 40 tons per hour. The motor 108 to drive the mills 104 and the heat-exchange apparatus 360 is attached to the melting reservoir 102. The water discharged from the discharge 106 is discharged conveniently into a storm drain 402.

Figure 5:
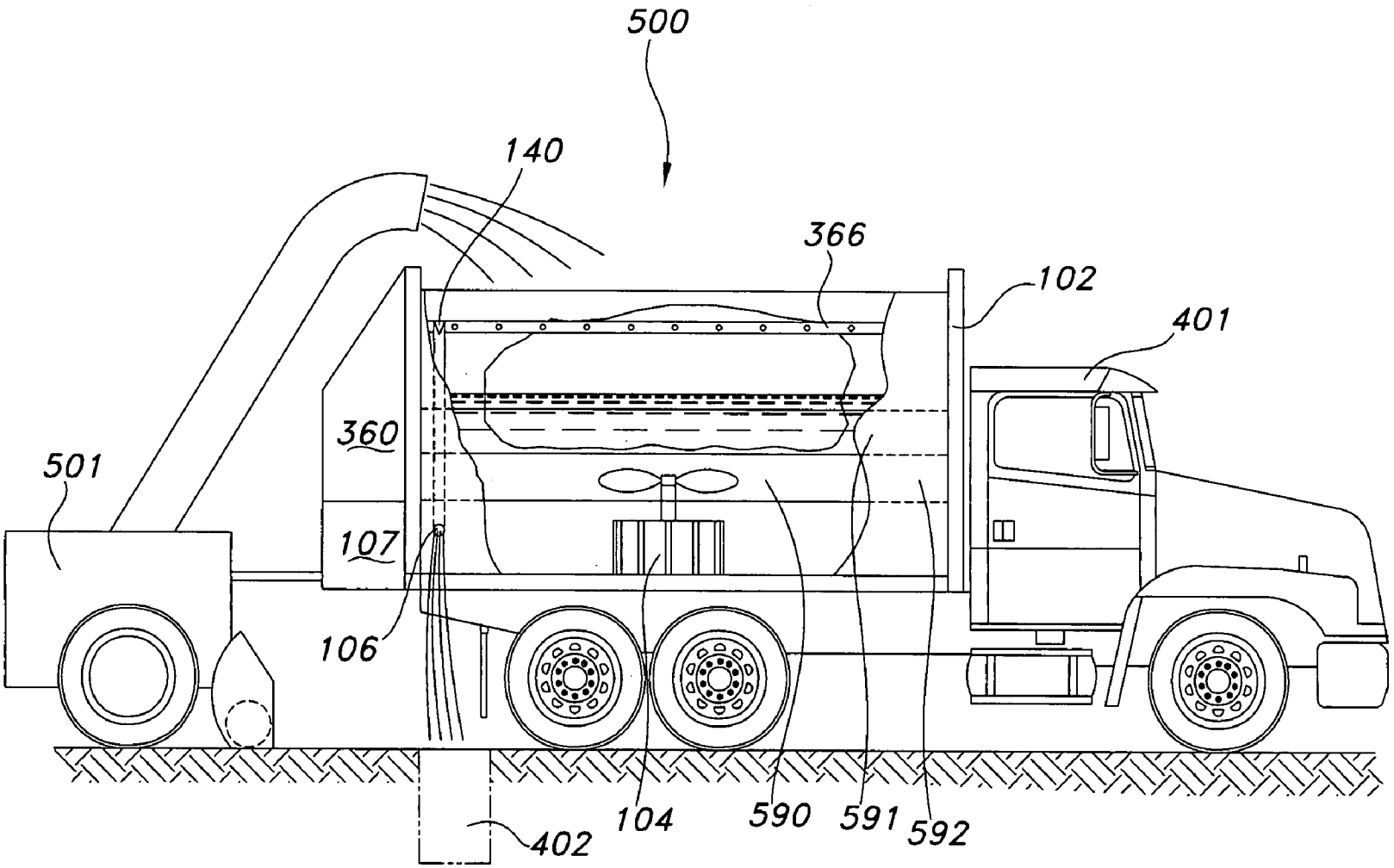
FIG. 5 is an illustration of a second embodiment of the mobile snow-liquefying unit according to the invention, showing the use of a snowblower to load snow into the melting reservoir.

FIGS. 4 and 5 illustrate various means of loading snow into the melting reservoir 102, although it is within the scope of the invention to use any suitable means to load the melting reservoir. As shown in FIG. 4, the snow-liquefying system 400 includes a conveyor 404 that is used to load the snow into the melting reservoir 102, and as shown in FIG. 5, the snow-liquefying system 500 includes a snow blower 501 for loading the snow into the melting reservoir 102. For purposes of illustration only, the snow blower 501 is shown being towed behind the snow-liquefying apparatus 100. Other configurations of the snow-liquefying system 400 according to the invention may include the snow blower 501 as an independent piece of equipment.

Figure 6:
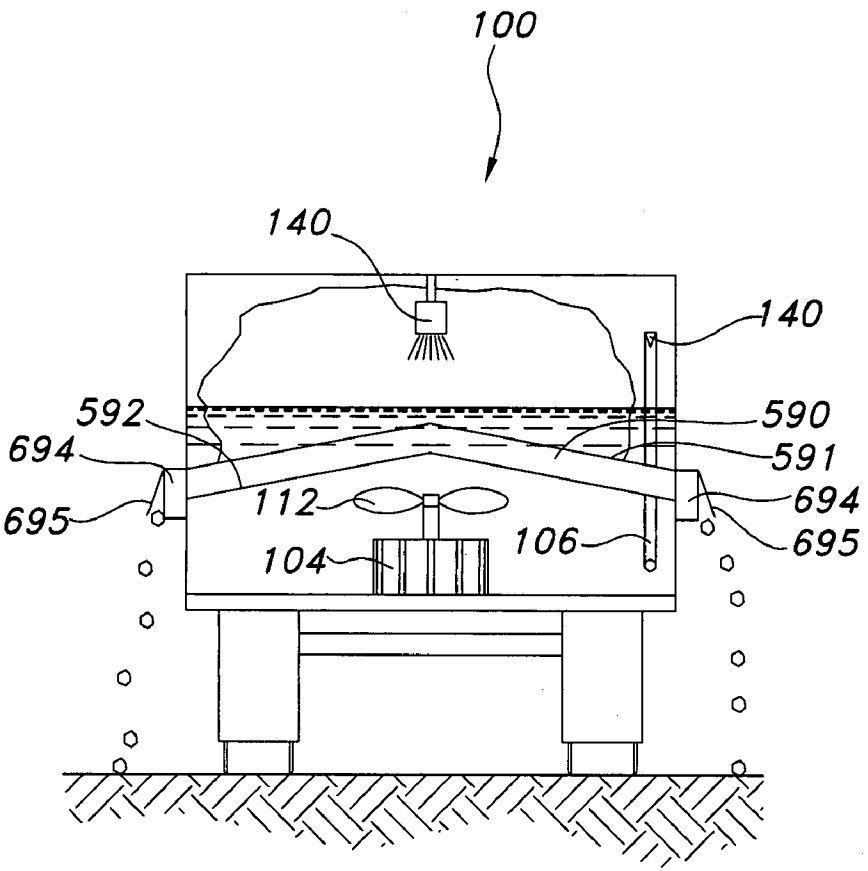
FIG. 6 shows a debris collection system.

FIGS. 5 and 6 also illustrate a debris collector 590 for protecting the rotor-stator device 104 (and propeller mechanism 112, if used) from debris that may be entrained in the snow and ice. For purposes of illustration, it is as though the side panel or rear wall panel of the apparatus 500 and 100, respectively, have been removed, exposing the rotor-stator device 104, the discharge 106, and various other devices or sub-assemblies as described below. In the embodiments shown, the debris collector 590 includes a large mesh screen 591 and a fine mesh screen 592. The debris that is trapped by the debris collector 590 falls under force of gravity toward a debris collection chamber 694, which is a collection box or tube in which the debris is collected. In the embodiment shown, the debris collection chamber 694 has a debris release 695 for discharging the collected debris from the snow-liquefying apparatus 100. The debris release 695 may be a releaseable door or hatch through which debris drops to the ground, or be an access door, through which the collection chamber 694 is cleaned. The debris screen 590 is shown used with the snow-liquefying apparatus 100, 500 although it is understood that it may be used with any embodiment of the snow-liquefying apparatus and/or systems described herein.

The overflow control device 140, seen in FIGS. 1, 4, 5, and 6 is shown as a vertical weir, i.e., a V-shaped weir slot. The overflow control device 140 is situated at the top of the discharge 106. As the water level rises above the lower end of the weir slot, water drains through the overflow control device 140 into the discharge 106, as a means of preventing the melting reservoir 102 from overfilling. The overflow control device 140 is constructed such that, as the water level rises toward its upper end, water is drained from the melting reservoir 102 at an increasingly rapid rate.

Figure 7:
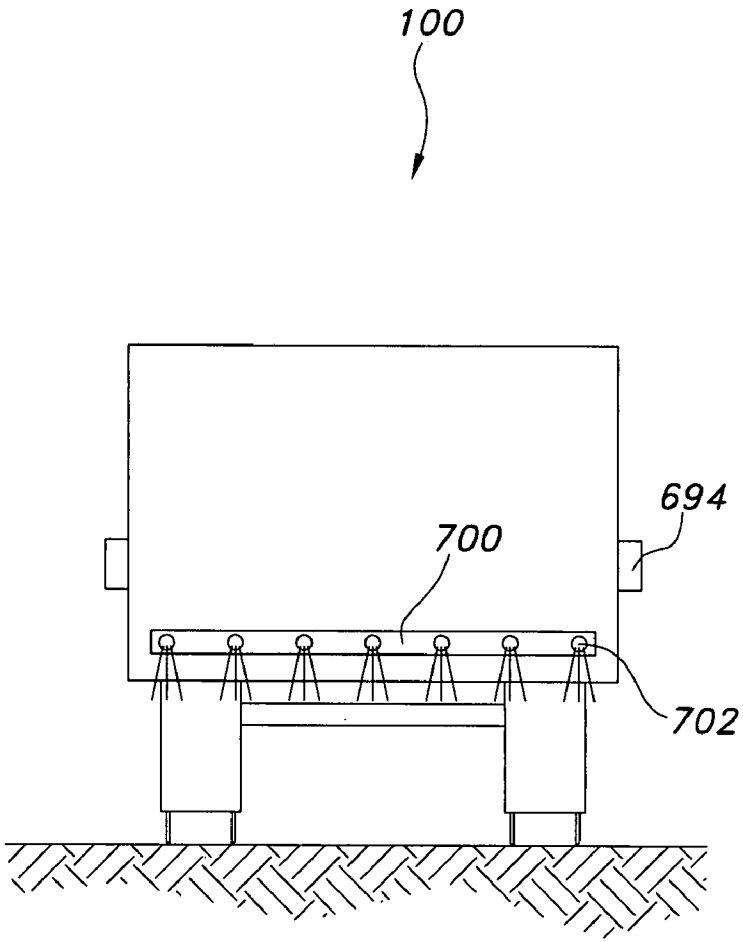
FIG. 7 shows a ground surface treatment system.

FIG. 7 shows a ground-surface treatment system 700, which includes a distribution spray bar 702 for evenly spraying melt-aid treated discharge. Adding low eutectic melting aid to the water bath, as described above, results in a liquid that has a freeze point below 32 degrees F., which makes the melt-aid treated discharge suitable for pavement freeze-bond prevention pre-treatment preceding a snowfall. This pre-treatment prevents falling snow from freeze-bonding to pavement, thereby making it easier to remove new-fallen snow from the pavement. Preferably, the ground-surface treatment system 700 is used with the snow-liquefying apparatus 100 that is configured as a mobile unit as shown in FIGS. 4 and 5. The melt-aid treated discharge is discharged from the melting reservoir 102 via the discharge 106, to which the distribution spray bar 702 is attached.

The method according to the invention is as follows. Using any embodiment of the snow-melting apparatus 100, Snow is loaded into the melting reservoir 102, which is partially filled with a water bath. The rotor-stator device 104 is rotating at high speed, causing turbulence in the water bath. The snow and water are forced through the rotor slots 224 and flung against the faces of the stator 234. This flinging of the snow out through the rotor slots 224 creates great turbulence, which generates heat that works on the snow, and causes the particles of snow to impinge directly on the perpendicular faces of the stator 234, causing the particles to break into their smallest particle size and, again, generating heat that works on the particles. In addition to the heat that is generated by the mechanical forces of compression and friction operating on the snow directly, the mechanical action of the rotation of the rotor-stator device 104 generates a substantial amount of heat that is added to the snow/water mix.

One of the key features of the method according to the invention is that the snow does not have to be heated to a temperature above freezing to change to a liquid state. Rather, the turbulence generated at the ends of the rotor slots and the direct impingement of the snow against other particles of snow and against the stator faces cause the snow to liquefy at temperatures below freezing. The inventor of the present invention has achieved liquefaction of snow at ambient temperatures of 26 F, without adding melting aids, such as salt, or other heat sources external to the rotor-stator device 104 and the drive system 107, such as combustion or resistance heating. Ideally, the liquid discharged from the snow-liquefying apparatus is discharged into a storm drain or other collection means that is below ground and which, therefore, provides an ambient temperature that is above freezing.

In some applications, it may be desirable to add chemical melting aids, such as salt, to increase the throughput of the snow-liquefying apparatus according to the invention. In such cases, relatively small amounts of salt added to the snow-water mix in the reservoir 102 significantly enhance the melting action of the apparatus. The mechanical forces that break the snow into its smallest particle size have the same effect on the salt, that is, they break the salt into its smallest particle size. This increases the direct contact between particles of salt and snow, thereby increasing the speed and efficiency of the melting action due to the salt.

While descriptions of several embodiments of the invention are disclosed herein, these descriptions are not intended to be limiting. Rather, the general principles set forth herein are considered to be merely illustrative of the scope of the present invention as claimed and it is to be further understood that numerous changes may be made without straying from the scope of the present invention.

What is claimed is:

1. A method of liquefying snow and/or ice, said method comprising:

a) providing a melting reservoir for receiving snow and/or ice and maintaining a water bath in said melting reservoir;

b) providing a rotor-stator device within said melting reservoir, said rotor-stator device having a rotor with rotor discharge apertures and a stator with stator apertures, c) placing snow and/or ice in said melting reservoir; and d) rotating said rotor of said rotor-stator device at a speed high enough to force water and said snow and/or ice through said rotor discharge apertures and through said stator apertures.

2. The method of claim 1, further comprising the step of:

e) adding a melting aid to said water bath.

3. The method of claim 1, further comprising the step of:

f) circulating water from said melting reservoir through a heat-exchanger to warm said water from heat generated by auxiliary systems and feeding said warmed water back into said melting reservoir.

4. The method of claim 3 further comprising the step of spraying said warmed water onto said snow and/or ice in said melting reservoir.

5. The method of claim 2 further comprising the step of discharging melting-aid treated water through a distribution spray system onto pavement.

* * * * *